US009852569B2

(12) United States Patent
Mulvey et al.

(10) Patent No.: US 9,852,569 B2
(45) Date of Patent: Dec. 26, 2017

(54) CONVEYING MONEY ITEMS

(71) Applicant: Crane Payment Solutions Limited, Lancashire (GB)

(72) Inventors: Kevin Mulvey, Lancashire (GB); Robert Blythin, Lancashire (GB)

(73) Assignee: CRANE PAYMENT INNOVATIONS LIMITED, Lancashire (GB)

( * ) Notice: Subject to any disclaimer, the term of this patent is extended or adjusted under 35 U.S.C. 154(b) by 0 days.

(21) Appl. No.: 14/765,788

(22) PCT Filed: Feb. 4, 2014

(86) PCT No.: PCT/GB2014/050309

§ 371 (c)(1),
(2) Date: Aug. 4, 2015

(87) PCT Pub. No.: WO2014/118582

PCT Pub. Date: Aug. 7, 2014

(65) Prior Publication Data

US 2015/0371477 A1 Dec. 24, 2015

(30) Foreign Application Priority Data

Feb. 4, 2013 (GB) ..... 1301900.5
Feb. 4, 2013 (GB) ..... 1301902.1

(51) Int. Cl.

| | |
|---|---|
| ***G07D 1/00*** | (2006.01) |
| ***G07D 9/00*** | (2006.01) |
| ***G07D 3/00*** | (2006.01) |
| ***G07D 9/04*** | (2006.01) |

(52) U.S. Cl.

CPC ..... *G07D 9/00* (2013.01); *G07D 1/00* (2013.01); *G07D 3/00* (2013.01); *G07D 9/008* (2013.01); *G07D 9/04* (2013.01)

(58) Field of Classification Search

CPC .. G07D 1/00; G07D 3/00; G07D 9/00; G07D 9/008

USPC ..... 453/1, 3, 4, 7, 11, 33, 35, 49, 55–57, 5; 235/379; 382/134, 136

See application file for complete search history.

(56) References Cited

U.S. PATENT DOCUMENTS 3,463,171 A * 8/1969 Dolman ..... G07D 9/008 198/431
4,228,812 A * 10/1980 Marti ..... G07D 3/14 453/5
4,396,029 A * 8/1983 Anderson ..... G07D 3/123 453/15
4,535,794 A * 8/1985 Bellis ..... B65G 47/1471 221/253

(Continued)

FOREIGN PATENT DOCUMENTS

GB 2416061 A 1/2006
WO WO 2009030651 A2 3/2009

OTHER PUBLICATIONS

International Search Report dated May 8, 2014 in connection with International Patent Application No. PCT/GB2014/050308; 4 pages.

(Continued)

*Primary Examiner* — Jeffrey Shapiro

(57) ABSTRACT

An apparatus for conveying money items, which is configured to singulate money items during conveyance, sense characteristics of money items during conveyance and eject money items from a conveyor.

20 Claims, 12 Drawing Sheets

(56) References Cited

U.S. PATENT DOCUMENTS 4,681,204 A * 7/1987 Zimmermann ..... G07D 5/00 194/317
6,328,646 B1 * 12/2001 Abe ..... G07D 9/008 198/550.01
6,579,166 B2 * 6/2003 Abe ..... G07D 9/008 453/56
8,844,704 B2 9/2014 Bell
8,991,584 B2 3/2015 Nishida
2003/0032387 A1 * 2/2003 Abe ..... G07D 9/008 453/56
2005/0277378 A1 * 12/2005 Schimpl ..... G07D 9/008 453/18
2008/0261505 A1 * 10/2008 Bellis ..... G07D 9/008 453/29
2009/0008215 A1 * 1/2009 Bell ..... G07D 3/14 194/342
2009/0047889 A1 * 2/2009 Adams ..... G07D 3/14 453/5
2010/0015903 A1 1/2010 Nishida
2010/0203817 A1 * 8/2010 Rigo ..... G07D 3/14 453/3
2010/0210200 A1 * 8/2010 Bell ..... G07D 9/008 453/3
2010/0227539 A1 * 9/2010 Aguado Vitas ..... G07D 1/00 453/56
2011/0105002 A1 * 5/2011 Blaha ..... G07D 3/14 453/58
2012/0122385 A1 * 5/2012 Watson ..... G07D 3/14 453/56
2012/0261434 A1 10/2012 Bell
2012/0276828 A1 * 11/2012 String ..... G07D 3/128 453/10
2014/0187134 A1 * 7/2014 Stieber ..... G07D 3/14 453/4
2014/0194045 A1 * 7/2014 Fischer ..... G07D 3/14 453/3
2015/0221154 A1 * 8/2015 Fischer ..... G07D 3/14 453/7

OTHER PUBLICATIONS

Written Opinion of International Searching Authority dated May 8, 2014 in connection with International Patent Application No. PCT/GB2014/050308; 5 pages.

* cited by examiner

CONVEYING MONEY ITEMS

CROSS-REFERENCE TO RELATED APPLICATION(S)

The present application claims priority under 35 U.S.C. §365 to International Patent Application No. PCT/G132014/050309 filed Feb. 4, 2014, entitled "CONVEYING MONEY ITEMS". International Patent Application No. PCT/GB2014/050309 claims priority under 35 U.S.C. §365 and/or 35 U.S.C. §119(a) to United Kingdom Patent Application No. 1301900.5 filed Feb. 4, 2013, and United Kingdom Patent Application No. 1301902.1 filed Feb. 4, 2013, and which are incorporated herein by reference into the present disclosure as if fully set forth herein.

FIELD

This specification relates to conveying money items. Particularly, but not exclusively, the specification relates to singulating money items during conveyance, sensing characteristics of money items during conveyance and ejecting money items from a conveyor.

BACKGROUND

The characteristics of money items vary widely. For example, the dimensions and materials of money items such as coins and tokens differ significantly. The differences are present both within individual currencies and between different currencies.

The variations between different money items have presented a challenge to the money item conveying industry because it has been difficult to singulate and convey all world money items using a single conveyor. In particular, the large differences in size between the largest and smallest world coins and other money items have made it difficult to provide a conveying track which is capable of reliably separating and individually presenting all of the different money items for payout and other purposes. A solution which has been adopted previously is to provide interchangeable conveying tracks so that a suitably shaped and sized conveying track can be installed in or order to suit the specific money items which are to be conveyed.

An example of a prior art conveying track is illustrated in FIG. 1. The track members are large enough to accept and convey large world coins, but a consequence of their size is that each track member is also capable of conveying two small world coins without singulation. Therefore, if such small coins or other money items are fed onto the track members, a possible consequence is an unintended double-payout, or similar, which is undesirable.

Another issue which is relevant to money item conveyors, and particularly those which convey money items of different denominations and currencies, is the capability to validate or otherwise check the money items which are being conveyed on the conveyor. For example, it is desirable to check that the money items being conveyed on the conveyor are those which are expected or desired at the destination.

Incorporating suitable automatic money item sensing equipment into a conveying system has been problematic because of the small space envelopes which industry requires the conveying system to fit within. The resulting compact nature of conveying systems has left little space for the sensing equipment, particularly in the regions around the conveying track.

SUMMARY

According to an aspect of the specification, there is provided a money item conveying member of a money item conveyor, comprising: a money item support section configured to support a primary money item on the conveying member during movement of the conveyor; and a money item release section configured to release one or more surplus money items from the conveying member; wherein the conveying member is arranged to direct the surplus money items into the release section when a primary money item is in the support section.

The money item release section does not support a money item on the conveying member during movement of the conveyor and thereby releases the surplus money items.

The release section may be configured to release the surplus money items immediately and without conveyance.

The money item support section may be configured to support the primary money item only.

The support section may comprise a money item conveying surface which is arranged to abut an edge of the primary money item to convey it forwards in the movement direction of the conveyor.

The conveying surface may be approximately perpendicular to the movement direction of the conveyor.

The conveying surface may stop short of the money item release section of the conveying member.

The support section may comprise a money item guide surface which is arranged to support a main face of the primary money item during movement of the conveyor.

The guide surface may be approximately parallel to the movement direction of the conveyor.

The money item conveying surface may be upstanding from the money item guide surface.

A height of the money item conveying surface above the money item guide surface may be approximately equal to or less than a thickness of the thinnest money item to be conveyed.

The guide surface may be located immediately forwards of the conveying surface in a conveying direction of the conveyor.

The money item conveying surface may extend in a direction which is partially across the conveying member and partially in the conveying direction of the conveyor.

The money item release section may comprise a chamfered region of the member over which the surplus money items slide off the member.

The surplus money items may be directed into the release section by movement of the primary money item in the support section.

The money item support section may be located next to the money item release section across the width of the conveying member.

The primary money item may be a coin or substantially circular token.

According to an aspect of the specification, there is also provided a money item conveying system comprising: a conveyor comprising a plurality of the money item conveying members; and a guide along which edges of primary money items are conveyed during movement of the conveyor.

The conveying surfaces of the conveying members may be configured to direct edges of the primary money items against the guide as the primary money items are conveyed.

The guide may be located directly adjacent to the money item support sections of the conveying members.

The guide may comprise a money item agitating region configured to agitate movement of surplus money items off the conveyor in order to singulate primary money items on the conveyor.

Movement of a primary money item against the agitating region of the guide may cause opposing movement of a surplus money item, on the same conveying member as the primary money item, into the money item release section of the member.

The money item conveyor may be configured to direct primary money items at least partially out of a conveying plane of the conveyor in the agitating region of the guide.

The agitating region of the guide may comprise a region which extends towards the conveyor configured to physically contact edges of surplus money items on conveying members and direct the surplus items into money item release sections of the conveying members.

The region may be configured to contact surplus money items which are resting edge to edge with a primary money item and forward of the primary money items in the conveying direction of the conveyor.

The guide may comprise a groove in which the edges of the primary money items are received as the money items are conveyed.

According to an aspect of the specification, there is provided a money item conveying system comprising: a money item conveyor configured to convey money items; and a money item guide along which the conveyor is configured to convey an edge of the money items; wherein the guide comprises a money item agitating region configured to agitate movement of surplus money items off the conveyor in order to singulate money items on the conveyor.

The conveyor may be configured to direct edges of the primary money items against the guide as they are conveyed.

Movement of a money item into the agitating region of the guide may cause opposing movement of a surplus money item into a money item release section of the conveyor.

The money item conveyor may be configured to direct primary money items at least partially out of a conveying plane of the conveyor in the agitating region of the conveyor path.

The agitating region of the guide may comprise a region which extends towards the conveyor configured to physically contact edges of surplus money items on the conveyor and direct the surplus items into a money item release section of the conveyor.

The region may be configured to contact surplus money items which are resting edge to edge with another money item and which are forward of the other money item in the conveying direction of the conveyor.

The agitating region of the guide may be in a money item escalating region of the conveyor path.

The money items may be coins or substantially circular tokens.

The guide may comprise a groove in which the edges of the primary money items are received as the money items are conveyed.

According to an aspect of the specification, there is provided a money item conveyor comprising: a money item conveying surface arranged to convey a received money item forwards when an edge of the money item contacts the conveying surface; and a money item ejecting surface arranged to direct the money item off the conveyor when an edge of the money item contacts the ejecting surface; wherein the money item conveying surface and the money item ejecting surface converge towards one another.

The money item conveyor may be arranged to support the money item between the money item conveying surface and the money item ejecting surface during conveyance.

The money item ejecting surface may be located forwards of the money item conveying surface in a conveying direction of the conveyor.

The money item conveying surface and the money item ejecting surface may be upstanding from a guide surface of the conveyor which is arranged to support a main face of the money item.

The money item conveying surface and the money item ejecting surface may be separated by the guide surface.

A plane of the money item conveying surface and a plane of the money item ejecting surface may be approximately perpendicular to a conveying direction of the conveyor.

Movement of the money item from the money item conveying surface to the money item ejecting surface may cause the money item to be directed off the conveyor by its impact angle with the ejecting surface.

The conveyor may comprise a longitudinal edge from which the money item conveying surface and the money item ejecting surface extend towards one another.

The money item conveying surface may extend from said longitudinal edge of the conveyor in a direction which is partially across the conveyor and partially in a conveying direction of the conveyor.

The money item ejecting surface may extend from the longitudinal edge of the conveyor in a direction which is partially across the conveyor and partially in an opposite direction to the conveying direction of the conveyor.

The money item conveying surface may be arranged to convey forwards money items received over said longitudinal edge of the conveyor.

The money item ejecting surface may be arranged to eject over said longitudinal edge money items which are received from the direction of the conveying surface.

The money item conveying surface may be located on a moving part of the conveyor and the money item ejecting surface may be located on a static part of the conveyor so that the conveying surface conveys the money item towards the ejecting surface.

A path of the conveyor may comprise a downward section in which the money item ejecting surface is located below the money item conveying surface.

In the downward section, a money item being conveyed by the conveying surface may fall against the money item ejecting surface and be ejected from the conveyor.

The conveyor may be an endless loop conveyor configured to move around a looped path.

The money items may comprise coins or substantially circular tokens.

The conveying surface may be configured to receive the money item from the same direction in which the ejecting surface is configured to direct the money item off the conveyor.

According to an aspect of the specification, there is provided a money item conveying system comprising: a money item conveyor configured to convey a money item; and at least one money item sensor located adjacent the money item conveyor and configured to sense at least one characteristic of the money item as it is conveyed; wherein the money item conveyor is configured to direct the money item at least partially out of a conveying plane of the conveyor and into a sensing plane of the adjacent sensor as the money item passes the sensor in a sensing region of the conveyor path.

The money item conveying system may comprise a guide located adjacent the conveyor against which the money item is conveyed past the sensor.

The conveyor may comprise a conveying surface which is configured to direct an edge of the money item against the adjacent guide.

The guide may comprise the bottom of a guide groove arranged to receive an edge of the money item so that the edge of the money item runs along the bottom of the groove as the money item is conveyed past the sensor.

The guide may be on the same side of the conveyor as the sensor.

A region between the guide and the conveyor into which the money item is directed may be out of the conveying plane of the conveyor and in the sensing plane of the sensor.

The distance between the conveyor and the guide may be greater in the sensing region of the conveyor path than it is in other regions of the conveyor path.

The at least one money item sensor may be located above and/or below the money item as it passes through the sensing region of the conveyor path.

The at least one sensor may be configured to detect physical and/or electromagnetic properties of the money item.

The conveyor may follow a looped path.

The sensing region may be located in a region of the conveyor path in which the money item is conveyed with a first of its faces against a fixed surface.

The sensing region may be located in a substantially horizontal region of the conveyor path in which the money item is conveyed with its first face against an approximately horizontal fixed surface.

The sensing region may be also located in a region of the conveyor path in which the money item is conveyed with a second of its faces against a fixed surface.

The sensing region may be located in a substantially upwardly travelling region of the conveyor path in which the money item is conveyed with its second face against a substantially vertical surface.

The system(s) may comprise a housing in which the first and second money item conveyors are located. A maximum height of the housing may be 285.5 mm or less in order to fit within standard industry size envelopes.

The money item may comprise a coin or substantially circular token.

BRIEF DESCRIPTION OF THE FIGURES

For the purposes of example only, embodiments of the invention are described below with reference to the accompanying figures in which.

DETAILED DESCRIPTION

Figure 1:
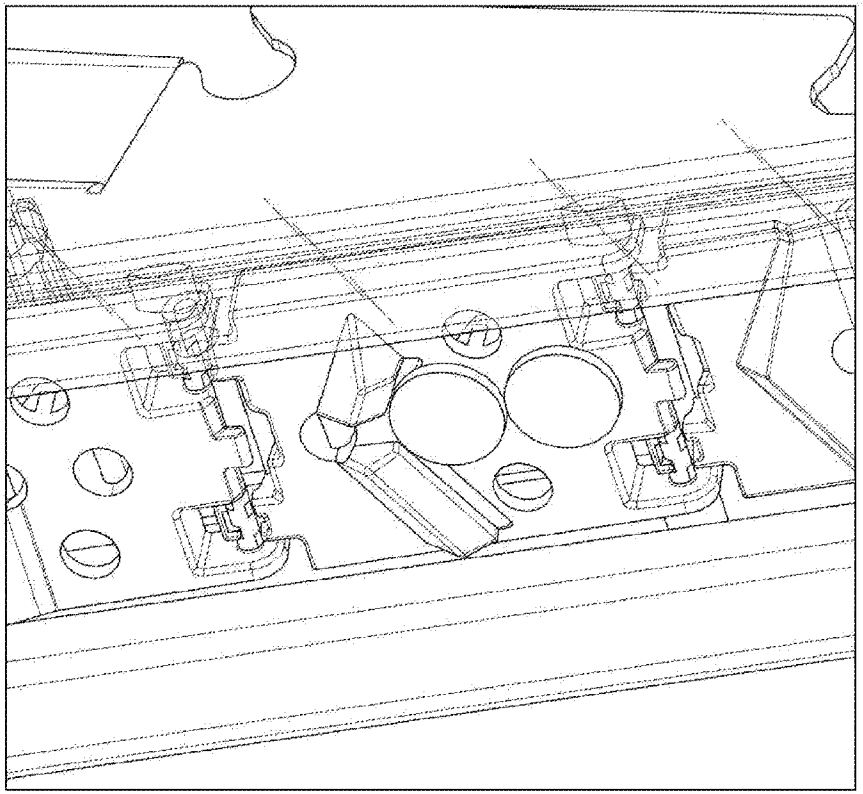
FIG. 1 is an illustration of a prior art money item track, on which two small diameter money items are being conveyed without being singulated.
Figure 2:
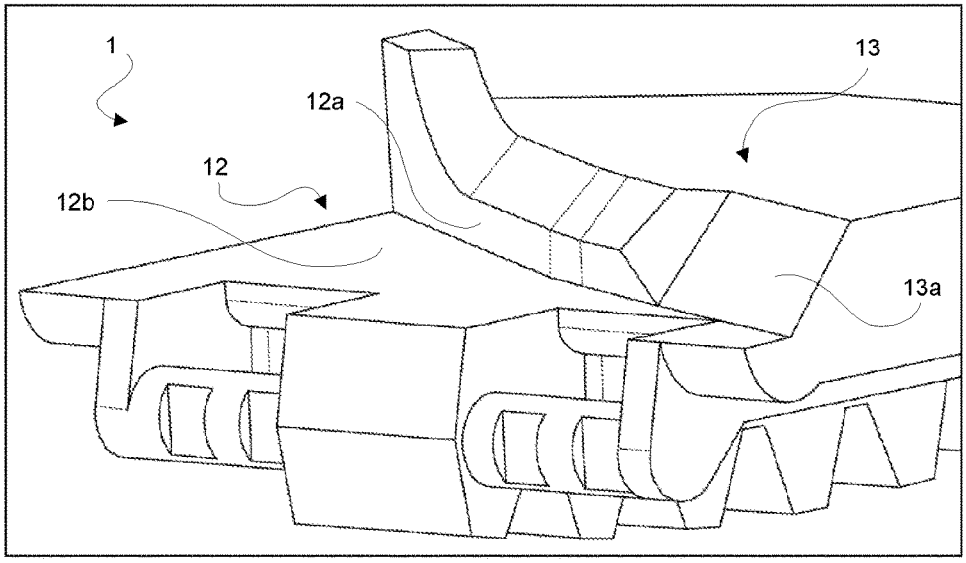
FIG. 2 is an illustration of a conveying member for conveying and singulating money items of different currencies and denominations.

A money item conveying member 1 of a money item conveying system 2 is illustrated in FIG. 2. The conveying member 1 is configured to singulate a money item on the member 1 and to individually convey the singulated money item to a conveyor exit 3 of a money item conveyor 4. At the exit 3, the money item leaves the conveying member 1 and enters another part of the system 2, such as a payout region, a storage hopper or a cash box.

The conveying member 1 may be one of a series of connected members 1 which together form the money item conveyor 4. For example, the conveying member 1 may comprise part of an endless loop conveyor 4 which is configured to convey money items from a money item source 5 to the conveyor's exit 3. An example of a system 2 comprising two such conveyors 4 is shown in FIGS. 3 to 6, in which the conveyors 4 are configured to convey money items from the exits of money item sources 5 to money item payout regions 3. Movement of the conveyors 4 is caused by engagement with one or more controllable drive units 6, which cause the conveyors 4 to rotate around their looped paths. For example, referring to FIGS. 3 and 4, teeth on the outwardly facing, circumferential surface of each conveyor 4 may engage with a drive wheel 6 located at the outside of the conveyor 4 so that movement of the drive wheel 6 causes corresponding movement of the conveyor 4.

Figure 3:
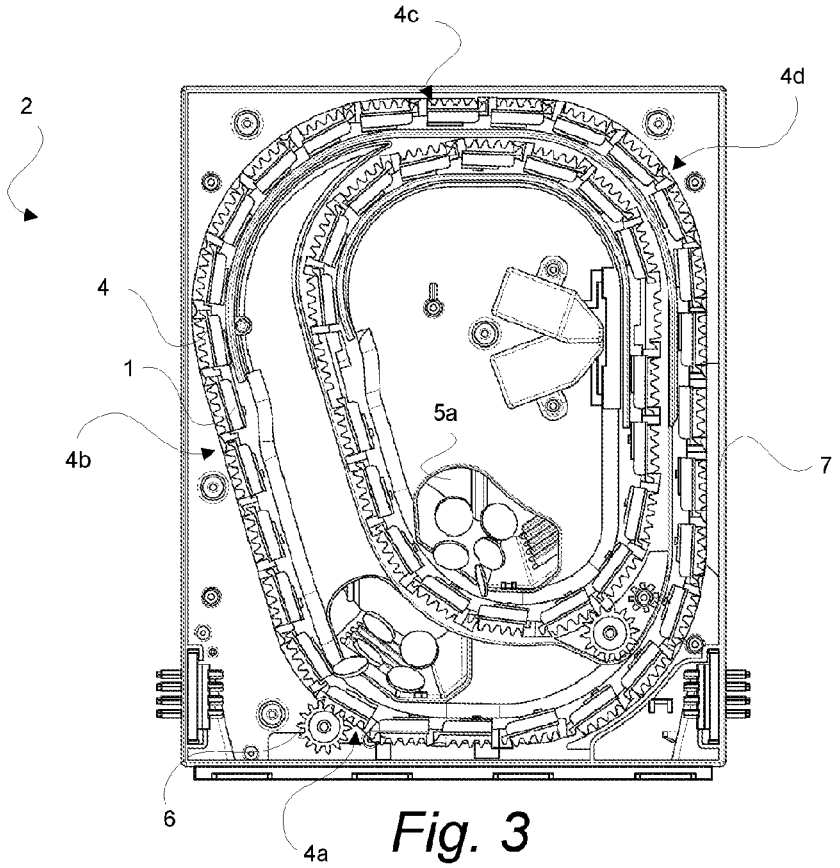
FIG. 3 is an illustration of two endless loop conveyors in a money item conveying system, wherein the shorter of the conveyors is located inside the longer of the conveyors.
Figure 4:
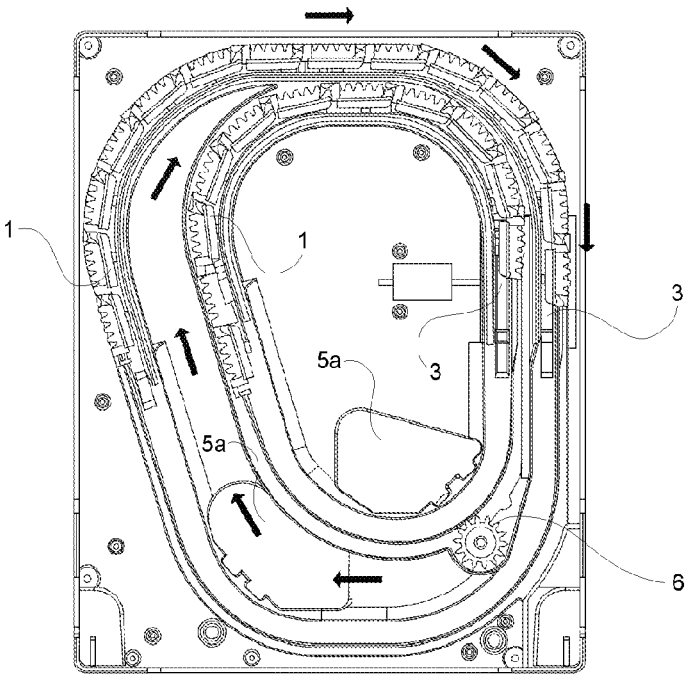
FIG. 4 is another illustration of two endless loop conveyors in a money item conveying system, indicating the conveying direction of the conveyors and the locations of money item exits for each conveyor.

As can be seen from FIGS. 3 and 4, the two conveyors are of different lengths. The shorter of the conveyors 4 is located entirely within the internal region of the longer conveyor 4 so that the looped path of both conveyors 4 is in the same plane. The alignment of the shorter conveyor 4 in the plane of the longer conveyor 4, as clearly shown in FIG. 5, increases the money item conveying capacity and flexibility of the conveying system 2, without occupying any more volume than would be occupied by the longer conveyor 4 alone. As such, the system 2 is able to conform to the standard size envelope used by industry whilst also offering extra conveying capacity.

The one or more conveyors 4 are located inside a housing 7 of the conveying system 2, along with other elements of the system 2 such as the money item sources 5. The height of the housing 7 is less than or equal to 284.5 mm+/−1.0 mm and therefore has a maximum height of 285.5 mm. This ensures that the height of the housing 7, and all of the elements of the system 2 within it, including the conveyors 4, is such that the system 2 fits within the standard size envelope required by the industry. The money item sources 5 are discussed below in the context of money item hoppers 5, although it will be appreciated that other types of feeding source could be used.

Figure 6:
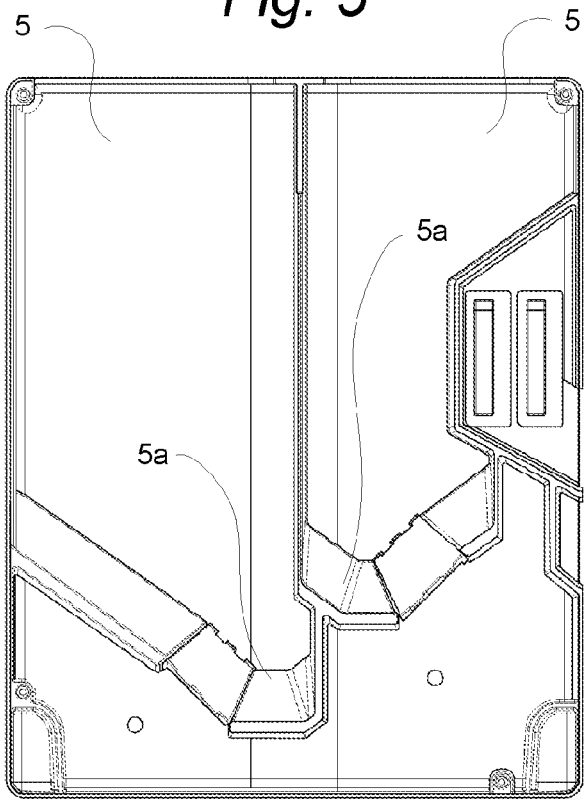
FIG. 6 is an illustration of two money item feeding containers which are dedicated to separate money item conveyors in a money item conveying system.

Although alternative configurations are possible, the number of hoppers 5, or other money item sources 5, may be equal to the number of conveyors 4 in the system 2 so that each hopper 5 is dedicated to feeding money items onto a single one of the conveyors 4. For example, as best shown in FIGS. 3 and 6, the illustrated system 2 comprises two hoppers 5 which respectively feed the two conveyors 4. The use of multiple dedicated hoppers 5 allows the system 2 to dispense different types of money item faster than would be the case with a single conveyor 4, single hopper 5 system, since different types of money item can be split between the hoppers 5 and thus dispensed immediately onto the associated conveyor 4 without the need to wait for the money items to be discriminated in a discriminator attached to the hopper.

Alternatively, the hoppers 5 may both contain the same type of money item. This would enable that type of money item to be dispensed to the exits 3 at approximately double the speed than that which would be possible with a single conveyor, single hopper system.

Figure 5:
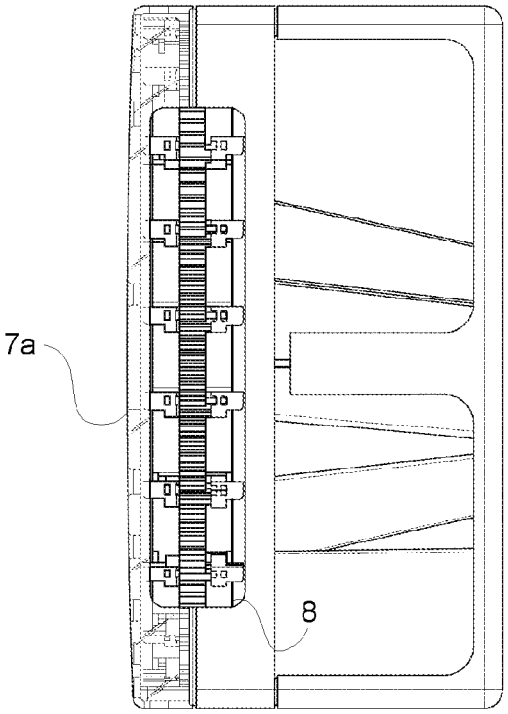
FIG. 5 is an illustration of a conveying system in which two conveyors are located adjacent to money item feeding hoppers.

Referring to FIG. 5, the arrangement of the system elements in the housing 7 may be such that the one or more conveyors 4 are located immediately adjacent to a side face 7*a* of the housing 7. Furthermore, the principal plane of the path of the conveyor(s) 4 may be substantially parallel to the side face 7*a* of the housing 7 so that the distance between the conveyor(s) 4 and the side face 7*a* of the housing 7 is substantially equal at all regions of the conveyor path.

The one or more hoppers 5 may also be located immediately adjacent the conveyors 4, on the opposite side of the conveyor(s) 4 to the aforementioned side face 7*a* of the housing 7, so that the conveyor(s) 4 are sandwiched between the side face 7*a* of the housing 7 and the hopper(s) 5. As schematically shown in FIG. 3, money items move onto the conveying members 1 from hopper exit(s) 5 located adjacent to the conveyor(s) 4 by sliding or otherwise moving over a longitudinal edge 8 of the conveyor 4 which is directly adjacent the hoppers 5. This edge 8 of the conveyor 4 is referred to in the description below as the money item receiving edge 8 of the conveyor 4.

Referring to back to FIG. 3, the money item feeding hopper(s) 5 are configured to feed money items onto the conveying members 1 of the conveyors 4 in a receiving region 4*a* of the conveyor path. For example, as best shown in the cut-away drawing of FIG. 6, the source(s) 5 may be configured to feed money items onto the conveyor 4 under gravity via an exit chute 5*a* located adjacent the money item receiving edge 8 in a receiving region 4*a* of the conveyor path.

In addition to the money item receiving region 4*a*, the path of each conveyor 4 also comprises an escalating region 4*b* and a bridge region 4*c*. As shown by the conveyance direction arrows in FIG. 4, the escalating region 4*b* immediately follows the receiving region 4*a* and comprises an upwardly extending section of the conveyor path in which money items on the conveying members 1 are lifted in an approximately vertical orientation into the bridge region 4*c* above. As shown in FIG. 3, the receiving region 4*a* of the conveyor path may be located at a point where the conveyor 4 begins to bend upwards from a substantially horizontal region at the bottom of the conveyor path into the escalating region 4*b*. The location of the receiving region 4*a* in an upwardly extending section of the conveyor path controls the flow of money items onto the conveyor 4 and so avoids the possibility of the receiving region 4*a* of the conveyor 4 being flooded with money items.

Although the escalating region 4*b* may be described as approximately vertical, it will be appreciated from a review of FIGS. 3 and 4 that the principal function of the escalating region 4*b* is to convey singulated money items upwards into the bridge region 4*c* and that it is not necessary for the escalating region 4*b* to be truly vertical for this to be achieved. For example, the conveying direction of the escalating region 4*b* may be off vertical by approximately 10° to 15°, or more, so that a main face of each singulated money items 14 leans against the inwardly facing surface of the conveyor 4 as it is conveyed upwards.

The bridge region 4*c* immediately follows the escalating region 4*b* and comprises an approximately horizontal section of the conveyor path in which characteristics of the money items are sensed as the money items are conveyed to the exit 3. This is described in more detail further below.

Figure 7:
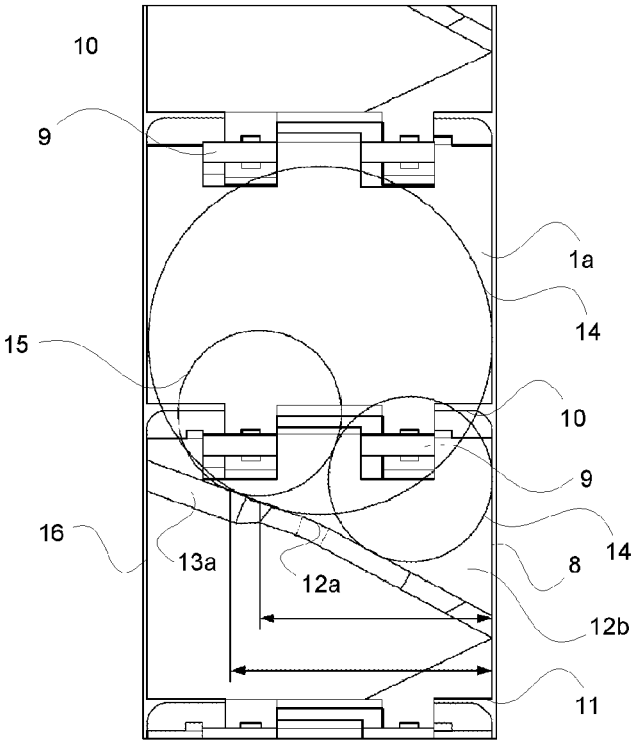
FIG. 7 is a plan view of the conveying surface of a money item conveying member, including outlines of large and small diameter world coins on the member.

Each of the plurality of conveying members 1 in the conveyor(s) 4 is connected to its neighbouring members 1 by hinges or otherwise flexible joints 9. For example, referring to FIG. 7, the leading and trailing edges 10, ii of each conveying member 1 may be hinged to corresponding edges 10, ii of the neighbouring conveying members 1 in order to allow the individual members 1 to move relative to one another and hence around bends in the looped path of the conveyor 4. Furthermore, as shown in FIG. 7, intermediate support members is may be hinged between neighbouring conveying members 1 in order to increase the number of hinges per unit length of the conveyor 4 and thereby improve smooth passage of the members 1 around the bends in the conveyor path.

Referring back to FIG. 2, each conveying member 1 comprises a money item support section 12 and a money item release section 13. Both sections 12, 13 are located on the inwardly facing surface of the conveying member 1 so that they are on the opposite side of the conveying member 1 to the drive teeth referred to above. The money item support section 12 is configured to support a single money item on the member 1 and to cause the money item to be conveyed with the member 1 to the conveyor exit 3. A money item accommodated in the support section 12 is referred to in the description below as a primary money item 14, since it is this money item 14 which is singulated and individually presented by the conveying member 1 at the exit 3.

The money item release section 13 is configured to release one or more surplus money items 15 from the member 1 by causing the surplus money items 15 to fall or otherwise move off the member 1 before the member 1 reaches the exit 3 intended for the primary money item 14. It is the release of surplus money items 15 by the release section 13, to leave only a single money item on each conveying member 1, which allows the conveying system 2 to singulate primary money items 14 and individually deliver the items 14 to the exit 3.

The money item release section 13 of the conveying member 1 is located adjacent the money item support section 12. Money items 15 which cannot be accommodated in the support section 12 are directed into the release section 13 and subsequently off the conveying member 1 to singulate the primary money item 14. The support and release sections 12, 13 may, for example, lie substantially side-by-side across the width of the conveying member 1, so that the sections 12, 13 span the member 1 in a direction which is approximately perpendicular to the conveyance direction of the conveyor 4.

Referring to FIGS. 2 and 7, the money item support section 12 may comprise a conveying support 12*a*, such as a ledge 12*a*, against which an edge of the primary money item 14 is located during conveyance. For example, in the case of a relatively thin money item such as a coin or circular token, the thin edge of the primary money item 14 may abut the support 12*a* during movement of the conveying member 1 so that the primary money item 14 is maintained in the support section 12 and is conveyed forwards with the member 1. The money item 14 is located forwards of a conveying surface of the support 12*a*, which faces forwards in the direction of movement of the conveying member 1. The conveying surface of the support 12*a* urges the primary money item 14 forwards in the direction of the conveyor 4 by exerting a driving force against the edge of the money item 14.

Figure 8:
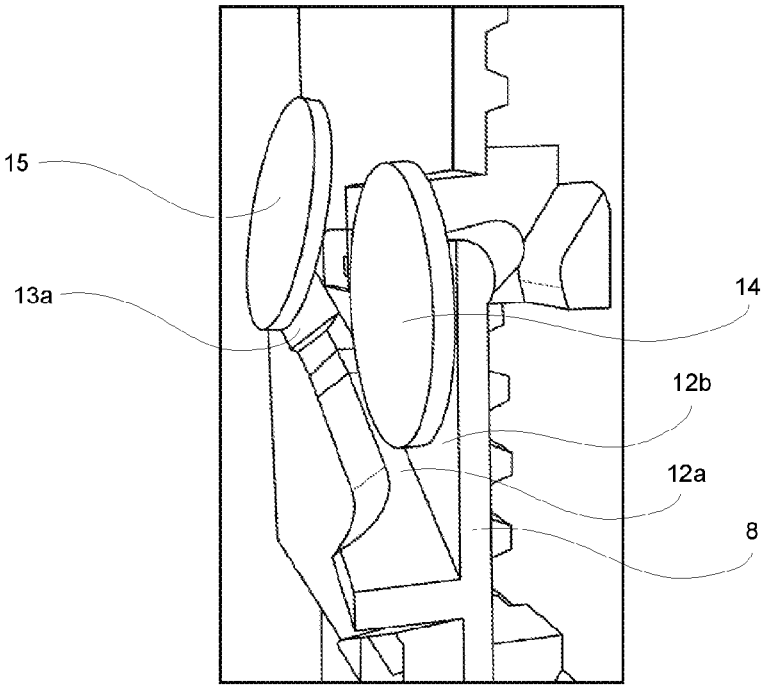
FIG. 8 is an illustration of a primary money item in a money item support section of a conveying member and a surplus money item being released from a money item release section of the conveying member.

The money item support section 12 of the conveying member 1 also comprises a guide support 12*b*, against which the main face of the primary money item 14 is located during conveyance. For example, in loop conveyors 4 such as those illustrated in FIGS. 3 and 4, a main face of the primary money item 14 rests against the surface of the guide support 12*b* during conveyance of the item 14 in the receiving region 4*a* and escalating region 4*b* of the conveyor path. The surface of the guide support 12*b* is approximately parallel to the direction of movement of the conveyor 4 and approximately perpendicular to the conveying surface of the conveying support 12*a* referred to above. This is illustrated in FIGS. 2 and 8, where it is shown that the surface of the support ledge 12*a* is approximately perpendicularly upstanding from the surface of the guide support 12*b* so that the primary money item 14 naturally locates at the junction between the surfaces 12*a*, 12*b* and is supported in this location during conveyance.

The height of the conveying support 12*a* above the surface of the guide support 12*b* may be chosen so as to reliably abut and convey the primary money item 14 without also abutting and conveying one or more surplus money items 15. For example, the height of the conveying support 12*a* above the guide support 12*b* may be chosen so as to be high enough to abut the thin edge of a primary money item 14 resting against the guide support 12*b* but not high enough to also abut and convey surplus money items 15 which might be lying face to face on top of the primary money item 14. The lack of abutment with the conveying support 12*a* causes such surplus money items 15 to slide over the top of the conveying support 12*a* towards the trailing edge 11 of the conveying member 1 and subsequently off the conveyor 4. For example, in a looped conveyor 4, such surplus money items 15 slide off the conveying member 1 under gravity. The items 15 may land back in the receiving region 4*a* of the conveyor path, from where they may be collected by another conveying member 1.

It will be appreciated that the height of the conveying support 12*a* should be selected in dependence of the thickness of the money items 14, 15 which are in circulation and which the conveyor 4 is intended to convey. The height of the conveying support 12*a* should be chosen so as to ensure that it reliably abuts and conveys all of the different money items which the conveyor 4 is intended to convey, without being sufficiently high to abut two of the thinnest money items lying face-to-face on the surface of the guide support 12*b*. The height of the conveying support 12*a* may, for example, be less than the thickness of the thinnest money item which the conveyor 4 is intended to convey. An example height is approximately 1.5 mm or less, such as approximately 1.4 mm or less, approximately 1.3 mm or less, or approximately 1.2 mm or less. The height may be greater than approximately 0.8 mm. It will be appreciated that other heights are also possible.

As best illustrated in FIG. 7, the conveying support 12*a* extends transversely across the conveying member 1 from the longitudinal money item receiving edge 8 of the member 1. As with its height, the length of the conveying support 12*a* and the angle at which it extends from the money item receiving edge 8 are chosen so as to support and convey a single money item 14 only. In particular, the conveying support 12*a* does not extend across the conveying member 1 to a degree which would be sufficient to abut and support two money items 14, 15 in an edge to edge arrangement across the width of the member 1.

The angle which the conveying support 12*a* makes with the money item receiving edge 8 may be non-perpendicular. More specifically, the conveying support 12*a* may extend from the money item receiving edge 8 in a direction which is both towards the opposite longitudinal edge 16 of the member 1 and also towards the leading edge 10 of the member 1. The conveying support 12*a* and the money item receiving edge 8 of the member 1 may therefore make an acute angle which faces towards the leading edge 10 of the member 1.

The length and angle of the conveying support 12*a* may be selected in dependence of the diameter of money items 14, 15 which are currently in circulation and which are intended to be conveyed. For example, the tangent points of the different money items with the upstanding surface of the conveying support 12*a*, as measured when the items 14, 15 are lying face down in the support section 12 on the guide support 12*b*, may be used to determine an appropriate length and angle for the conveying support 12*a*. In particular, the conveying support 12*a* should include the tangent point of the largest diameter money item to be conveyed but exclude the tangent point of the second of a pair of the smallest diameter money items lying edge to edge along the line of the conveying support 12*a*. An example of this is shown in FIG. 7, in which it can be seen that the illustrated conveying support 12*a* includes the tangent point of a large diameter world coin but excludes the tangent point of the second of a pair of small diameter world coins lying edge to edge.

An example range of values for the size of the forward-facing angle which the conveying support 12*a* makes with the money item receiving edge 8 is between approximately 5° and approximately 85°, although other angle sizes of less than 90° could alternatively be used.

Unlike the support section 12, the money item release section 13 is not configured to support money items on the conveying member 1 during conveyance. In particular, the release section 13 does not comprise a conveying support 12*a* of the type described above. As shown in FIGS. 2 and 7, the conveying support 12*a* of the support section 12 stops short of the release section 13 in a central region of the conveying member 1 and so, unlike the support section 12, the release section 13 is not configured to exert a conveying force against the edges of money items during movement of the conveyor 4.

The release section 13 instead comprises a money item release surface 13*a* which encourages money items 15 in the release section 13 to slide off the conveying member 1. In contrast to the conveying support 12*a*, the release surface 13*a* is not upstanding from the guide support 12*b* and so does not abut the edges of money items which are lying face-to-face with the conveying member 1. It instead allows the money items 15 to slide over the release surface 13*a* towards the member's trailing edge 11. An example of this is illustrated in FIG. 8, which shows how a surplus money item 15 may be ejected over the release surface 13*a* of the conveying member 1 as the conveying member 1 ascends the escalating region 4*b* of the conveyor path.

The release surface 13*a* is located side-by-side with the conveying support 12*a* across the width of the conveying member 1. For example, as can be seen from FIGS. 2, 7 and 8, the conveying support 12*a* and the release surface 13*a* may together traverse the entire width of the conveying member 1.

As best shown in FIGS. 2 and 8, the release surface 13*a* may be a chamfered surface of the member 1 which extends upwards and backwards from the surface of the guide support 12*b* towards the trailing edge 11 of the conveying member 1. The release surface 13*a* is non-perpendicular with the surface of the guide support 12*b* and may, for example, extend backwards at an acute angle of approximately 89° or less relative to the surface of the guide support 12*b*. An example angle is approximately 70°. As shown in FIG. 2, the rear portion of the conveying member 1, behind the conveying support 12*a* and the release surface 13*a*, may comprise a substantially flush surface over which surplus money items 15 are released.

Alternatively, the release surface 13*a* may be approximately parallel to the conveying direction of the conveying member 1. In particular, the plane of the release surface 13*a* may be approximately the same as the plane of the guide surface 12*b* of the adjacent money item support section 12 so that the two surfaces 13*a*, 12*b* are flush with one another.

In instances where surplus money items 15 on the conveying members 1 do not naturally locate in the release sections 13, the items 15 are physically directed into the release sections 13 by the conveying system 2 in order to ensure that the primary money items 14 are singulated before they reach the exit 3. This process will now be described in relation to the escalating region 4*b* of the conveyor path. However, it will be appreciated that the process could alternatively take place elsewhere on the conveyor path.

An example of part of the escalating region 4*b* of the conveyor 4 is illustrated in FIGS. 9 to 12. As shown, in this region, the conveyor 4 follows the path of a static guide 17 which is located adjacent to the money item receiving edge 8 of the conveyor 4. The money item receiving edge 8 of the conveyor 4 moves along the static guide 17 during money item transit. The static guide 17 supports primary money items 14 in the support sections 12 of the conveyor 4.

In particular, as shown in the figures, the angled nature of the conveying support 12*a* causes a primary money item 14 in the support section 12 of a conveying member 1 to be urged against the static guide 17 as the conveyor 4 moves forward, thereby retaining the primary money item 14 in the support section 12. Surplus money items 15 are not in contact with the angled conveying support 12*a* and as such, unlike the primary items 14, they are not urged against the static guide 17.

Figure 9:
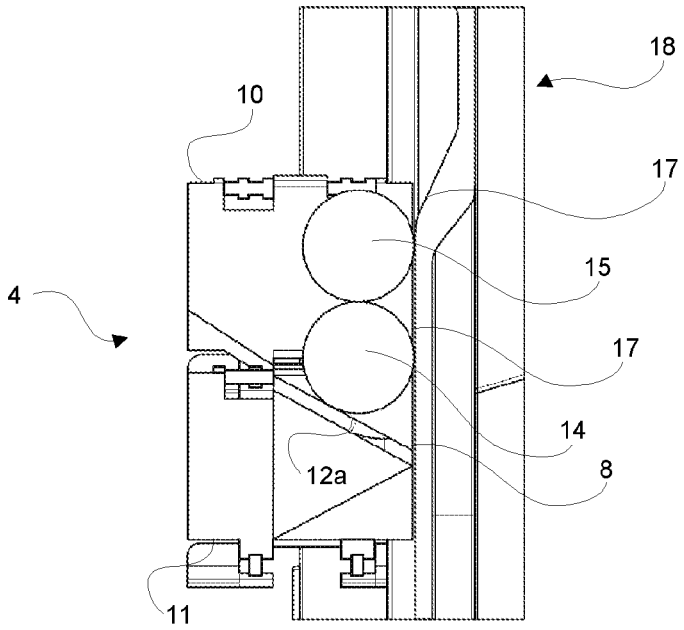
FIG. 9 is an illustration of two money items on a money item conveying member, shortly before a surplus one of the money items is caused to be released from the conveying member to singulate the items.

FIG. 9 illustrates a situation in which a conveying member 1 of the conveyor 4 has collected two small diameter money items 14, 15 in the money item receiving region 4*a* of the conveyor path. For the purposes of clarity in the illustration, the neighbouring conveying members 1 of the conveyor 4 have been omitted from the figure. As can be seen, a first of the money items 14 has naturally located itself in the support section 12 of the member 1 and has therefore become the primary money item 14.

The presence of the primary money item 14 blocks the second of the money items 15 from entering the support section 12 and thus the second money item 15 is forced into another part of the conveying member 1. FIG. 9 illustrates a situation in which, instead of immediately falling into the release section 13 or sliding over the top of the primary money item 14 and off the trailing edge 11 of the conveying member 1, the second money item 15 has located in a position which is forward of the primary money item 14 and close to the leading edge 10 of the conveying member 1. In this position, the edge of the surplus money item 15 abuts the edge of the primary money item 14 located directly behind it in the support section 12. The surplus money item 15 may therefore be conveyed forwards along the static guide 17 without falling into the release section 13.

In order to ensure that it is only the primary money item 14 which continues to be conveyed on the conveying member 1, and to prevent the surplus money item 15 from being undesirably conveyed to the exit 3, the static guide 17 comprises a surplus money item agitating region 18 which is configured to agitate movement of the surplus money item 15 into the release section 13 of the conveying member 1. In the agitating region 18, a section of the guide 17 extends away from the money item receiving edge 8 of the conveyor 4. This causes lateral movement of the primary money item 14, since its edge is being directed against the guide 17 by the conveying support 12*a*, and the result is that the surplus money item 15 is caused to move into the release section 13 of the conveying member 1.

For example, the agitating region 18 of the static guide 17 may comprise a groove 19, in which the edge of the primary money item 14 is received during conveyance of the item 14 up the escalating region 4*b* of the conveyor 4. Unlike the surplus money item 15 which is resting on the edge of the primary item 14, the primary money item 14 is directed into the groove 19 by the angled conveying support 12*a* of the conveying member 1.

Figure 10:
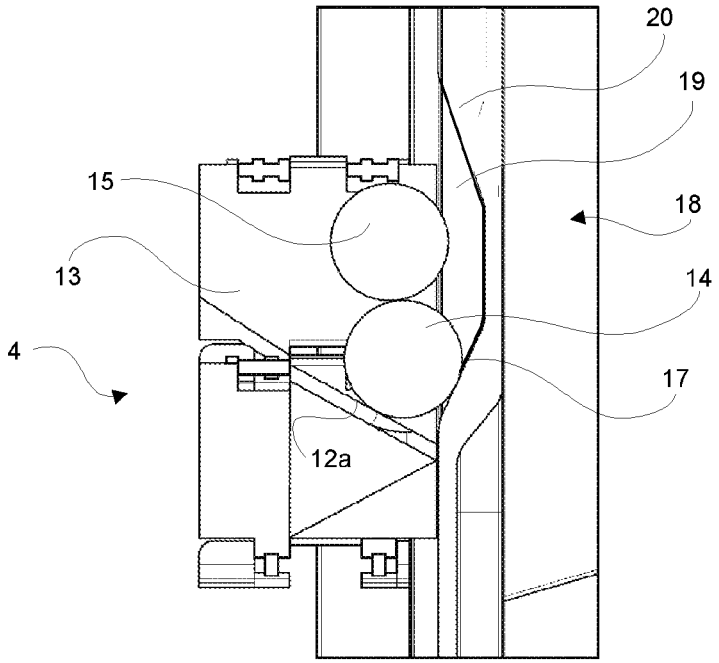
FIG. 10 is an illustration of a primary money item being caused to move into a guide groove by a money item support section of a conveying member and a surplus money item being caused to move into a money item release section of the member.

As shown in FIG. 10, movement of the primary money item 14 into the groove 19 causes the primary money item 14 to move partially over the money item receiving edge 8 of the conveying member 1 and further away from the money item release section 13. In doing so, the primary money item 14 moves partially out of the plane of the conveyor 4. This movement of the primary item 14 causes a misalignment between the primary item 14 and the surplus item 15 forward of it, which in turn causes the surplus money item 15 to roll in the opposite direction to the primary item 14 and hence towards the money item release section 13.

Figure 11:
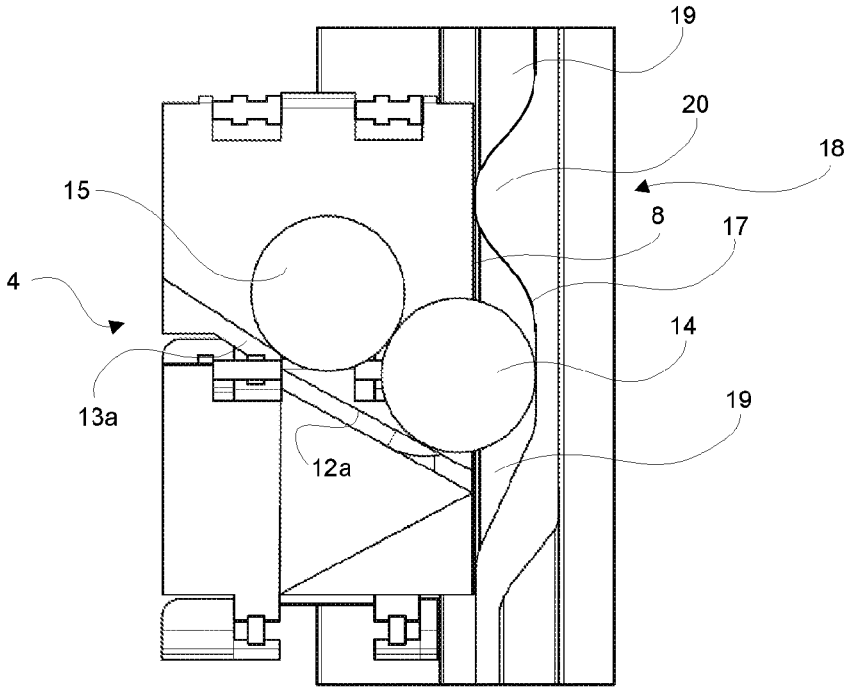
FIG. 11 is an illustration of a primary money item in a money item support section of a conveying member and a surplus money item in a money item release section of the conveying member.

Referring to FIG. 11, without the primary money item 14 directly behind it to convey it forwards, the surplus money item 15 moves immediately into a side by side relationship with the primary money item 14 across the width of the conveying member 1. Since the conveying support 12*a* does not include the tangent point of the surplus item 15 in this location, the surplus item 15 proceeds into the release section 13 from where it is released from the conveyor 4 in the manner previously described in relation to FIG. 8.

Figure 12:
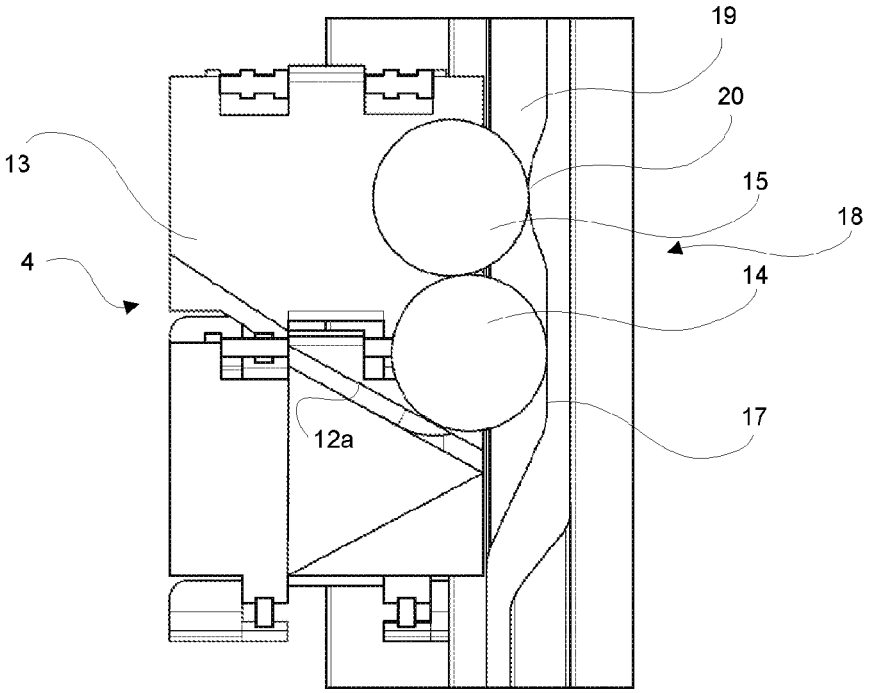
FIG. 12 is an illustration of an agitator section which directs surplus money items into a money item release section of a conveying member.

Referring to FIGS. 10 to 12, the agitating region 18 may further comprise a section 20 of the guide 17 which extends back towards the money item receiving edge 8 of the conveyor 4. This section 20 may comprise a projection 20, such as a bump or otherwise uneven surface, as shown in FIGS. 11 and 12. Alternatively, the section 20 may comprise an end region of the grove 19. An example of this is shown in FIG. 10. Although FIG. 10 does not illustrate it, the groove 19 may begin again marginally further along the conveyor path in order to once again receive the edge of the primary money item 14 and guide the primary money item 14 in a secured way towards the exit 3.

The purpose of the agitating region 18 is to ensure that any surplus money item 15 which did not move into the release section 13 following the initial movement of the primary money item 14 into the groove 19 does not remain on the conveying member 1. The section 20 of the guide 17 which extends back towards the money item receiving edge 8 of the conveyor 4 interacts physically with the surplus money item 15 and directs the surplus item 15 away from the guide 17 and into the release section 13.

For example, the section 20 of the guide 17 which extends back towards the money item receiving edge 8 of the conveyor 4 may comprise a region of the internal surface of the groove 19 in which the primary item 14 is located during conveyance of the primary item 14 up the escalating region 4*b* of the conveyor loop 4. The section 20 projects outwards from the otherwise smooth surface of the groove 19 and thus contacts the surplus money item 15 as it moves up the escalating region 4*b*. This contact causes sudden misalignment of the two money items 14, 15. As shown in FIG. 12, the surplus money item 15 moves past the centre line of the primary money item 14 behind it and onwards into the money item release section 13 as previously described in relation to FIGS. 8 and 11. Therefore, even in the event that a surplus money item 15 somehow initially slips into the groove 19 along with the primary money item 14, the agitating region 18 ensures that the surplus money item 15 is directed into the release section 13 before the conveying member 1 reaches the bridge region 4*c* of the conveyor path.

It should be noted that, although the primary money item 14 also physically interacts with the section 20 of the guide 17 which extends back towards the money item receiving edge 8 of the conveyor 4 as it moves up the escalating section 4*b*, it is prevented from being directed into the release section 13 of the conveying member 1 by the angled nature of the conveying support 12*a* which continually urges the money item 14 against the static guide 17 and thus retains the money item 14 inside the groove 19.

It should also be noted that the degree to which the guide 17 extends back towards the money item receiving edge 8 of the conveyor 4 should be chosen in order to ensure that the deviation which it causes to the money items 14, 15 is sufficient to direct all surplus money items 15 into the release section 13. Three different examples are shown in FIGS. 10, 11 and 12. FIGS. 10 and 11 show examples in which the guide 17 extends fully back to the edge 8 of the conveyor 4, whilst FIG. 12 illustrates an example in which the guide 17 extends only approximately half of the distance back towards the edge 8 of the conveyor 4.

Figure 13:
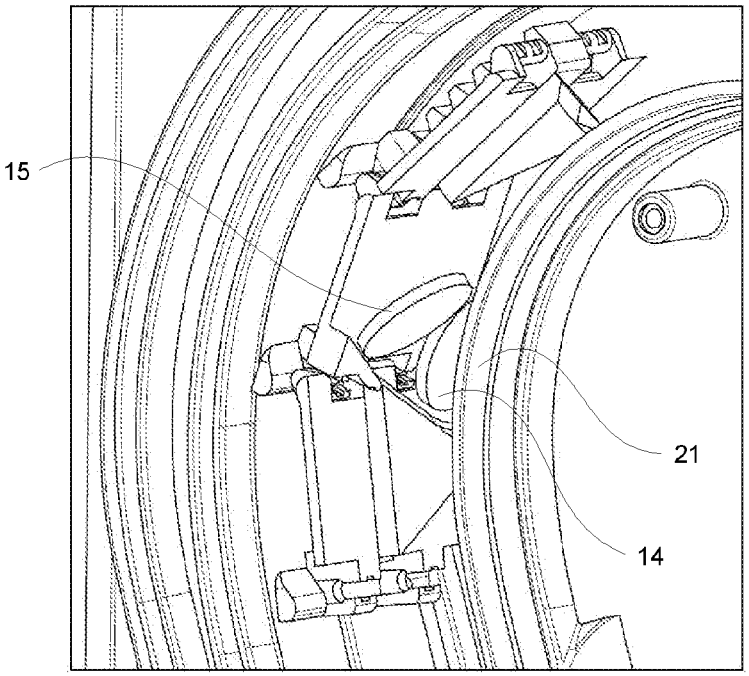
FIG. 13 is an illustration of a conveying member moving from an escalating region of the conveyor path to a bridge region of the conveyor path.

As explained previously, the escalating region 4*b* of the conveyor 4 is followed by the bridge region 4*c*. The transition from the escalating region to the bridge region comprises a bend in the conveyor path, around which the primary money items 14 are conveyed and caused to re-orientate from a substantially vertical orientation in the escalating region 4*b* to a substantially horizontal orientation in the bridge region 4*c*. The transition is illustrated in FIG. 13, which shows how a bridge 21 located adjacent to the inwardly facing surface of the conveyor 4 supports the main face of a primary money item 14 against gravity as the main face of the item 14 falls forward and inwardly from the surface of the guide support 12*b*.

The bridge 21 overlaps the support sections 12 of the conveyor 4 and thereby ensures that as the primary money item 14 falls forwards away from the surface of the guide support 12*b*, the item 14 is prevented from falling off the conveying member 1. However, as can be seen from FIG. 13, the bridge 21 does not overlap the release sections 13 of the conveyor 4 and therefore ensures that any remaining surplus money items 15 in the release sections 13 now fall unsupported against gravity away from the conveyor 4 and back into the receiving region 4*a*.

Figure 14:
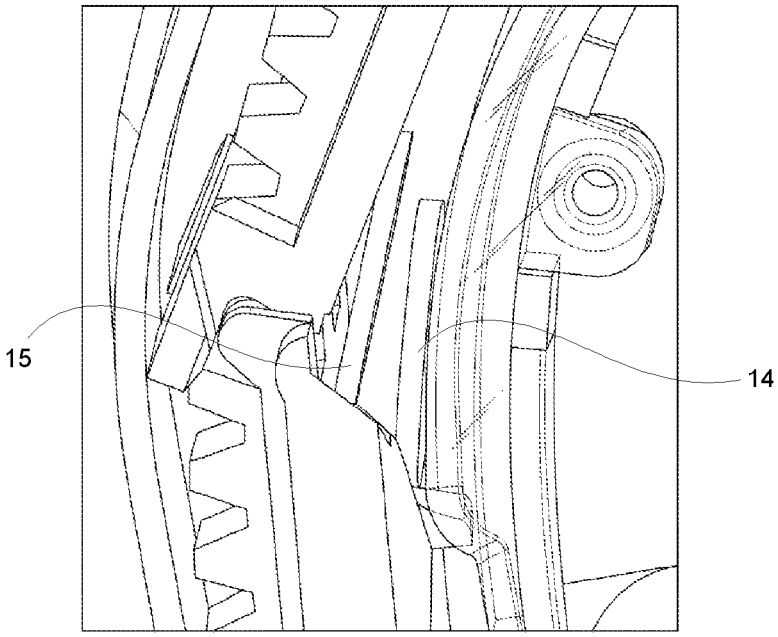
FIGS. 14 and 15 are illustrations of situations which are prevented by the invention, in which two money items lie face-to-face on a conveying member.
Figure 15:
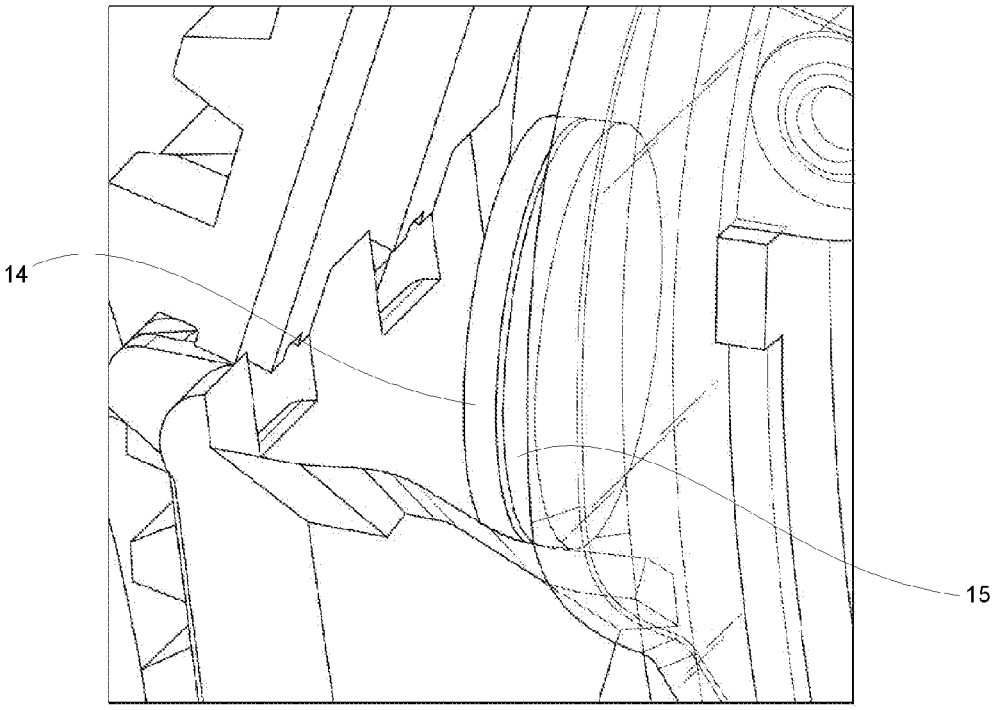

The situations illustrated in FIGS. 14 and 15, in which money items are conveyed face to face on a single conveying member 1 and thus not singulated, are avoided.

Figure 16:
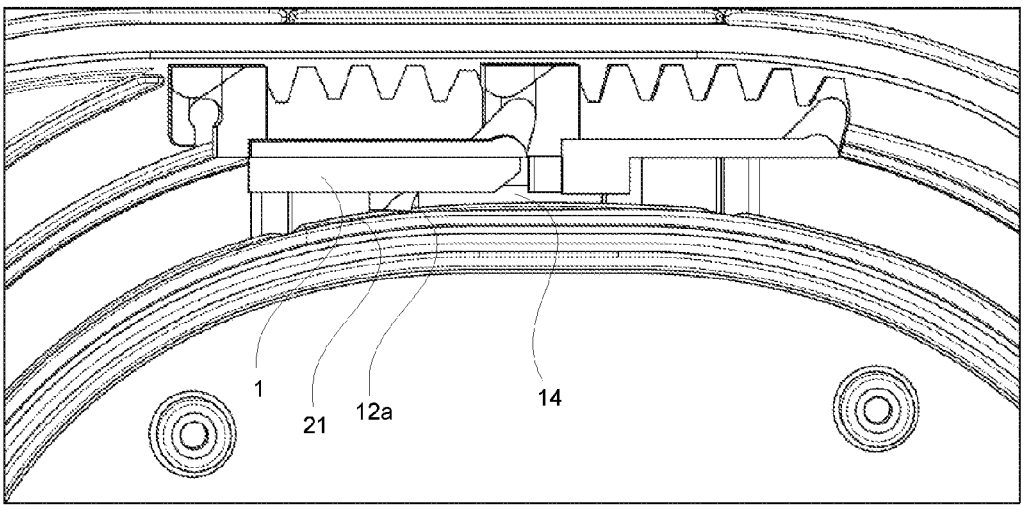
FIG. 16 is an illustration of a money item being conveyed through a money item sensing region on a bridge of the conveyor path.

Referring to FIG. 16, in the bridge region 4*c* of the conveyor 4, a main face of each primary money item 14 is conveyed along a substantially horizontal path of the bridge 21 by the conveying supports 12*a*. As explained above, the bridge 21 is located inside the circumferential path of the conveyor 4 and is therefore underneath the money items 14 in this section of the path. In contrast, the conveyor 4 is located above the bridge 21 and therefore may sandwich the money items 14 between it and the bridge 21. This is shown in FIG. 16, where is can be seen that the outwardly facing surface of the bridge 21 directly faces the guide supports 12*b* of the conveying members 1.

During the transition from the escalating region 4*b* to the bridge region 4*c*, and subsequently when the primary money item 14 is on the bridge 21, the edge of the money item 14 continues to be conveyed along the static guide 17 by to the angled nature of the conveying support 12*a*. More specifically, the edge of the primary money item 14 remains inside the guide groove 19 referred to previously, so that the edge of the money item 14 is located in the guide groove 19 as the item 14 is conveyed along the bridge 21 by the conveying support 12*a*. The passage of the money item 14 from the escalating region 4*b* to the bridge region 4*c* is aided in its reliability by the location of the money item 14 inside the guide groove 19. This is particularly the case with the inner, shorter of the conveyors 4 because of the short radius of curvature of the bend between the escalating region 4*b* and the bridge region 4*c*. The passage of the money item 14 around the bend between the escalating region 4*b* and the bridge region 4*c*, and the associated transition from a substantially vertical orientation to a substantially horizontal orientation, is smoothed by the guiding effect of the groove 19, which keeps the money item 14 stable during the change in orientation.

It will be understood that this effect of the groove 19 is particularly applicable to the inner conveyor 4 because, in addition to being limited by its confinement within the limited height of the housing 7, which as previously discussed is small enough to fit within the standard size envelope specified by industry, the radius of curvature of the bend between the escalating region 4*b* and the bridge region 4*c* of the inner conveyor 4 is further limited by the confinement of the inner conveyor 4 within the outer conveyor 4.

Referring to FIGS. 3 and 4, an associated effect of the guide groove 19 is to ensure that the leading edges of money items 14 on the escalating region 4*b* of the conveyor 14 do not cause a jam by striking the end face of the bridge 21 as the money items 14 are conveyed into the bridge region 4*c*. This is because the guide groove 19 helps to maintain the main faces of the money items 14 substantially against the guide supports 12*b* in the escalating region 4*b* of the conveyor path.

In the bridge region 4*c* of the conveyor 4, the money items 14 are at their most stable because of the way in which they lie face down on a substantially horizontal surface 21. This stability, together with the fact that all of the primary money items 14 have been singulated and the money items 14 are approaching the conveyor exit 3, contributes to the bridge region 4*c* being an appropriate location in the conveyor path to perform sensory checks on the money items 14.

Figure 17:
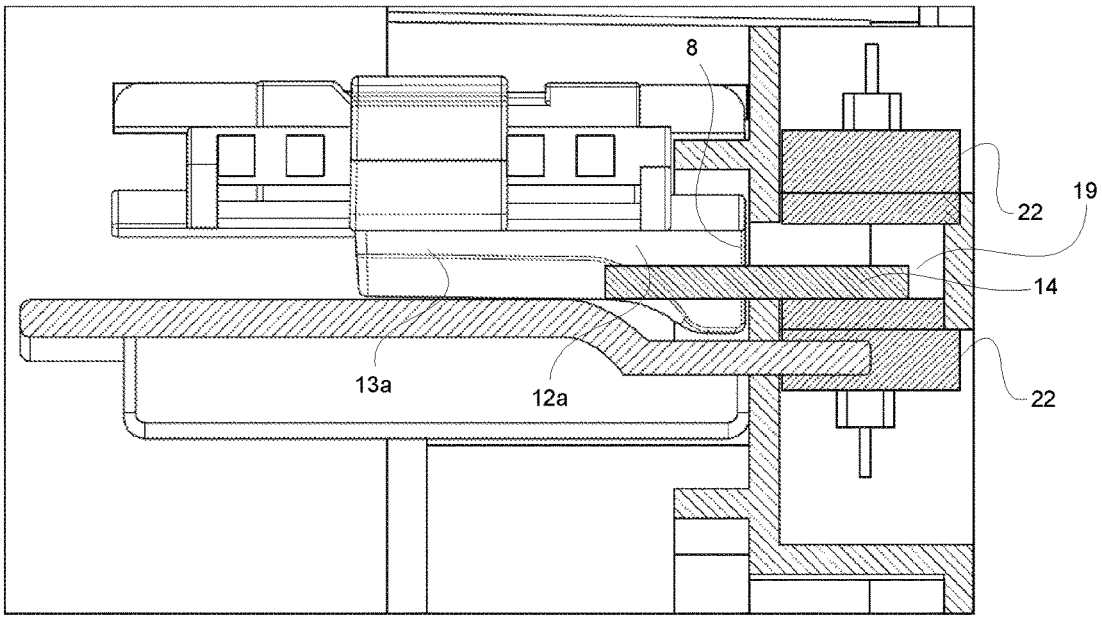
FIG. 17 is an illustration of a money item which has been directed laterally out of the plane of a conveyor and into a money item sensing groove so that characteristics of the money item can be sensed by sensors which are out of the plane of the conveyor.
Figure 18:
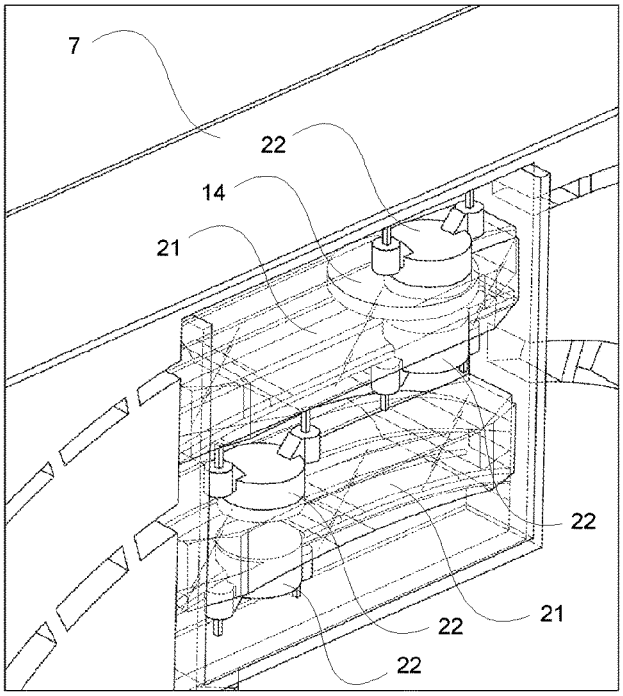
FIG. 18 is an illustration of money item sensors which are located adjacent the paths of two money item conveyors in bridge regions of the conveyors.

Referring to FIGS. 17 and 18, the money item conveying system 2 may comprise one or more money item sensors 22 which are located in one or more money item sensing regions of the conveyor path and are configured to sense characteristics of the primary money items 14 as the money items 14 are conveyed. A suitable location for a money items sensing region is in the bridge region 4*c* of the conveyor path, so that characteristics of the money items 14 are sensed as they are conveyed over the bridge 21. The sensors 22 may, for example, be configured to sense physical or electromagnetic characteristics of the money items 14, such as the items' dimensions, shape, conductivity, permeability, construction and other properties.

The sensor(s) 22 may be located adjacent to the money item receiving edge 8 of the conveying members 1 in the bridge region 4*c*. For example, as shown in FIG. 17, the sensor(s) 22 may be located directly above and/or below the guide groove 19 in which the money items 14 are conveyed along the bridge 21. In order to locate the money items 14 as close as possible to the sensor(s) 22 as the items 14 move over the bridge 21, the items 14 are moved substantially out of the plane of the conveyor 4 into a deep section of the guide groove 19. More specifically, the guide groove 19 may be deeper in the bridge region 4*c* of the conveyor 4 than it is in other areas of the conveyor path so that money items 14 move even further over the money item receiving edge 8 of the conveying members 1. For example, FIG. 17 illustrates a situation in which more than half of a money item 14 is over the item receiving edge 8 of a conveying member 1 as it is conveyed through the deep region of the guide groove 19. The location of the money items 14 in the deep region of the guide groove 19 is substantially out of line with the path of the conveyor 4, enabling the items 14 to pass directly under, over and/or between the sensors 22 and for the sensors 22 to view or otherwise sense characteristics of the money items 14 without obstruction from the conveyor 4.

It will be appreciated that, whatever the thickness of the money item 14 which is being conveyed, the money item face which lies directly against the surface of the bridge 21 will always be in the same location. This means that the distance between the sensor(s) 22 and the face of the money item 14 which is directly against the surface of the bridge 21 will be constant regardless of the thickness of the money item 14. The sensors 22 can be positioned so as to reduce this distance to a minimum, or so as to obtain an otherwise optimum distance, such as approximately 0.5 mm, between the sensors 22 and the downwardly-facing face of the money item 14 in the bridge region 4*c*. This allows the sensors 22 to detect characteristics of different money items 14 reliably and consistently, without any variation in the measurement distances involved.

However, it will also be appreciated that the distance between the surface of the bridge 21 and the upwardly-facing face of the money item 14 will vary for different money item thicknesses. This means that the distance between that upwardly-facing money item face, which is referred to below as the opposite face, and any fixed position sensors 22 in the bridge region 4*c* of the conveying system 2 will vary for different thicknesses of money item 14.

In order to enhance the coin properties sensed over those in the bridge region 4*c*, the opposite face of the money item 14 may be sensed in a sensing region located in a different region of the conveyor path. More specifically, the money item system 2 may additionally, or alternatively, comprise one or more money item sensors 22 in a region of the conveyor path where the position of the opposite faces of the money items 14 can be accurately predicted regardless of the money item thickness. Referring back to FIG. 3, an example of this is in the escalating region 4*b* of the conveyor path, in which the opposite faces of the money items 14 lie against the surfaces of the guide supports 12*b*. The location of the opposite face is therefore consistent in this region 4*b*, regardless of the thickness of the money item 14 being sensed.

As with the money item sensing section of the bridge region 4*c* described above, the money item sensing section in the escalating region 4*b* comprises a deep groove of the type described above in relation to FIGS. 16 to 18. The money items 14 are moved out of the plane of the conveyor 4, over the money item receiving edge 8 of the conveyor and towards the hoppers 5, so that characteristics of the money items 14 can be sensed without obstruction from the conveyor 4.

Measurements made by the sensors 22 may be used, for example, to validate that the money item 14 which is being conveyed over the bridge 21 is of the type which is desired at the money item exit 3. The result of the validation operation may be used to determine the path which the money item 8 should take after being ejected from the conveyor 4. For example, money items 8 which are validated as being of the desired type may be channeled into a payout region of the conveying system 2, whereas money items 14 which are not of the desired type may be channeled back into an appropriate storage hopper 5 of other storage region.

Referring back to FIGS. 3 and 4, the bridge region 4*c* of the conveyor path is followed by a money item ejection region 4*d* in which money items 14 are ejected from the conveying members 1 through the conveyor exit 3. In the money item ejection region 4*d*, the conveyor 4 conveys the money items 14 in a downward section of the conveyor path located approximately opposite the escalating region 4*b*. As with the escalating and bridge regions 4*b*, 4*c* described previously, the money items 14 may be guided in a groove 19 of the static guide 17 located adjacent the money item receiving edge 8 of the conveying members 1. The money items are ejected from the conveyor 4 over the money item receiving edge 8 into the exit 3, which may for example comprise an aperture 3 in the static guide 17.

Figure 19:
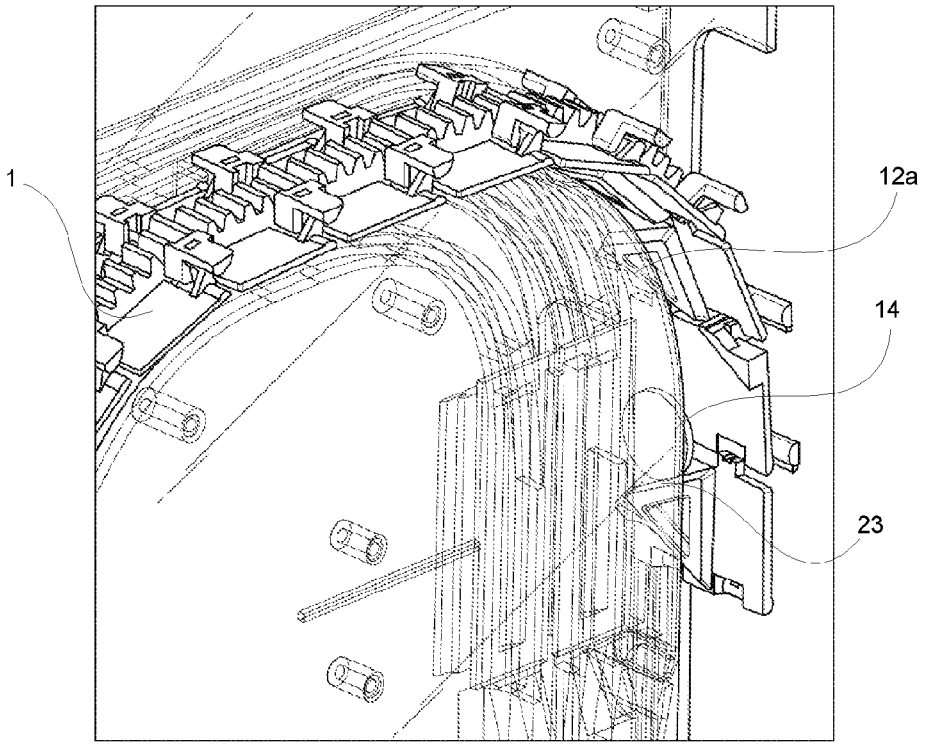
FIG. 19 is an illustration of a money item falling from a money item conveying surface of a conveying member onto a money item ejecting surface of a neighbouring conveying member and, upon striking the ejecting surface, being diverted off the conveyor.

A perspective illustration of the ejection region 4*d* of the outer conveyor 4 is shown in FIG. 19. As can be seen, in this region 4*d* of the conveyor path, the money items 14 may fall under gravity against a money item ejecting surface 23 of the conveyor 4 which directs the money items 14 off the conveyor 4. More specifically, having previously been pushed through the escalating and bridge regions 4*b*, 4*c* of the conveyor path by the conveying supports 12*a*, the primary money items 14 lose contact with the conveying supports 12*a* in the ejection region 4*d* because the conveying supports 12*a* are located above them and do not support them against gravity.

Figure 20:
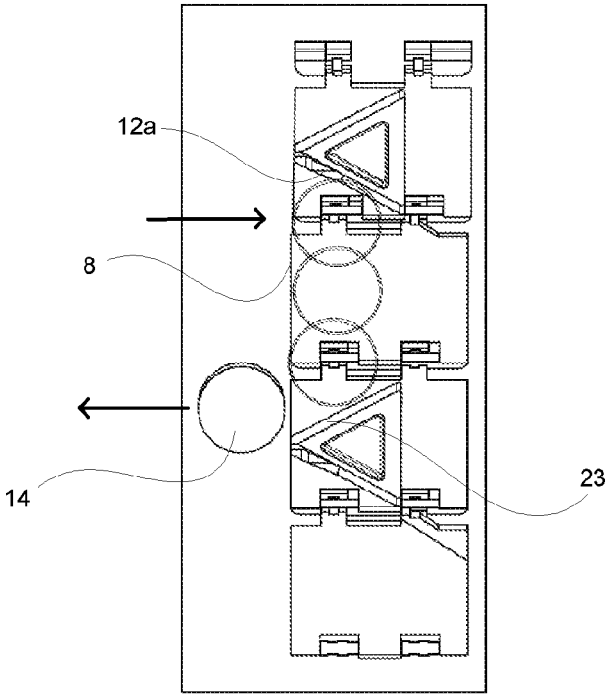
FIG. 20 is a plan view of the surface of a money item conveyor which comprises money item conveying surfaces and money item ejecting surfaces which converge towards the conveying surfaces.

Referring to FIG. 20, the money item ejecting surface 23 is similar to the surface of the conveying support 12*a* in that it is an upstanding surface 23 which is approximately perpendicular to the direction of conveyance of the conveyor 4. As with, the conveying support 12*a*, the ejecting surface 23 may form an approximately perpendicular junction with the surface of the guide support 12*b* of the support section 12 and may extend from the money item receiving edge 8 of the conveyor 4 at a non-perpendicular angle. The ejecting surface 23 may also have a similar height and length to the conveying support 12*a*. However, the angle of the ejecting surface 23 is approximately opposite to the angle of the conveying support 12*a* so that the ejecting surface 23 and the surface of the conveying support 12*a* converge towards one another from the money item receiving edge 8 of the conveyor 4. More specifically, instead of extending forwards from the money item receiving edge 8 in the direction of conveyance, the ejecting surface 23 extends backwards from the edge 8 in approximately the opposite direction.

The angle of the ejecting surface 23 relative to the direction of movement of the conveyor 4, and hence the direction in which the money item 14 falls towards the ejecting surface 23, is such that contact between the edge of the falling money item 14 and the ejecting surface 23 directs the money item 14 towards the money item receiving edge 8 of the conveyor 4. The location in the conveyor path at which the money items 14 strike the ejecting surface 23 and are directed fully towards the money item receiving edge 8 corresponds to the location of the exit 3, so that the money items 14 pass through the exit 3 and off the conveyor 4.

As shown in FIG. 3, the money item ejecting region 4*d* is located on the opposite side of the conveyor loop to the escalating region 4*b*. This is made possible by the bridge region 4*c* described above, which allows money items 14 on the conveyor 4 to be transported to the opposite side of the looped path. The location of the ejecting region 4*d* and the associated money item exit path 3 aids the overall packaging of the system 2 in the housing 7, for example by allowing the money item exits of the conveyors 2 to be more closely packed together.

The location of the ejecting region 4*d*, and the bridge region 4*c* that facilitates it, is of particular help when accommodating all elements of a multiple conveyor system 2 within the standard industry size envelope discussed previously. One reason for this is that it allows money items on the conveyor(s) 4 to be ejected from the conveyor(s) 4 in a region of the conveyor path that is convenient for channeling the money items directly through the housing 7 to a payout area.

In some systems 2, such as those that comprise a single conveyor 4, the money item ejecting region 4*d* could be located in the escalating region 4*b* of the conveyor path to allow money items to be ejected off the conveyor 4 once they had been discriminated or validated by sensors 22 located further down the escalating region 4*b*. This could be considered an advantageous arrangement for such systems 2 because the conveyor 4 would be required to convey the money items only up the relatively short and straight escalating region 4*b*, thereby avoiding the potential complications discussed above with regard to bends in the conveyor path.

However, in the case of a system 2 that comprise two conveyors 4, such as those illustrated in FIGS. 3 and 4, the arrangement of the conveyors 4 within the limited size of the housing 7 makes it inconvenient for money items to be ejected from the conveyors 4 in the escalating regions 4*b*. This is because the escalating regions 4*b* of the two conveyors 4 are relatively far apart, as shown in FIG. 3, and so money items can not be exited from the two conveyors 4 in the same place. Each conveyor 4 would likely require its own dedicated money item payout channel, which would in turn occupy more space within the limited size of the housing 7. This problem cannot be easily solved by arranging the escalating regions 4*b* of the conveyors 4 closer together because, as can be seen from FIG. 3, this would place further undesirable restrictions on the location and/or size of the money item inlet chute 5*a* for at least the outer conveyor 4.

The bridge regions 4*c* address the problem by allowing money items to be conveyed from the escalating regions 4*b* to ejecting regions 4*d* on the opposite sides of the conveyor paths. As can be seen from FIG. 3, in this opposite region of the conveyor paths, the conveyors 4 can be located directly adjacent to one another, at the desired money item exit height, without the complications discussed above. By locating the money item ejecting regions 4*d* in this location, the money items are exited from the two conveyors 4 at substantially the same location and can from there be directed to a payout area via a shared channel through the housing 7.

As shown in FIG. 20, the conveying supports 12*a* and ejecting surfaces 23 operate in pairs, on the moving conveyor 4, to eject money items 14 from the conveyor 4 through the exit 3. In each pair, the ejecting surface 23 is located forward of the conveying support 12*a* on the conveyor 4. For example, as shown in FIGS. 19 and 20, the ejecting surface 23 and the conveying support 12*a* may be located on different conveying members 1 so that each primary money item 14 falls against the ejecting surface 23 of the next conveying member 1 in the endless loop as it leaves the conveyor 4. Alternatively, the ejecting surface 23 and the conveying support 12*a* may be located on the same conveying member 1.

Figure 21:
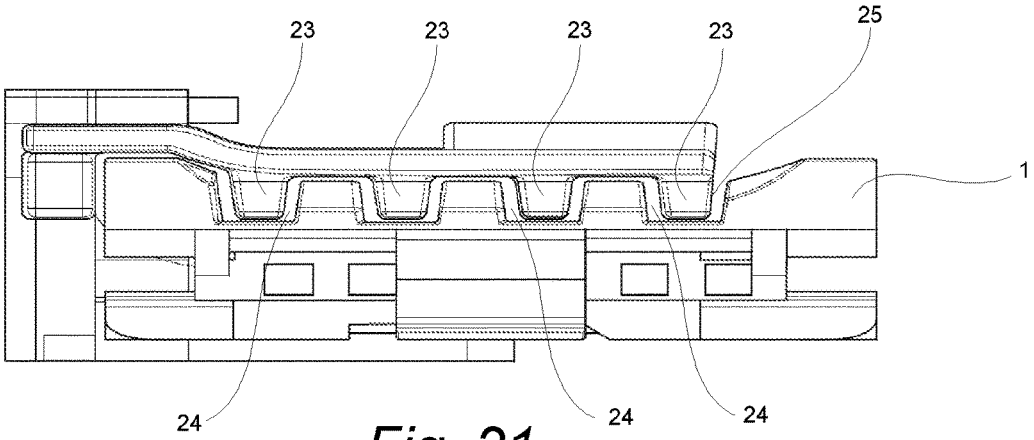
FIG. 21 is an illustration of a static money item ejecting member which engages with a moving money item conveyor and causes money items on the conveyor to pass through a conveyor exit.
Figure 22:
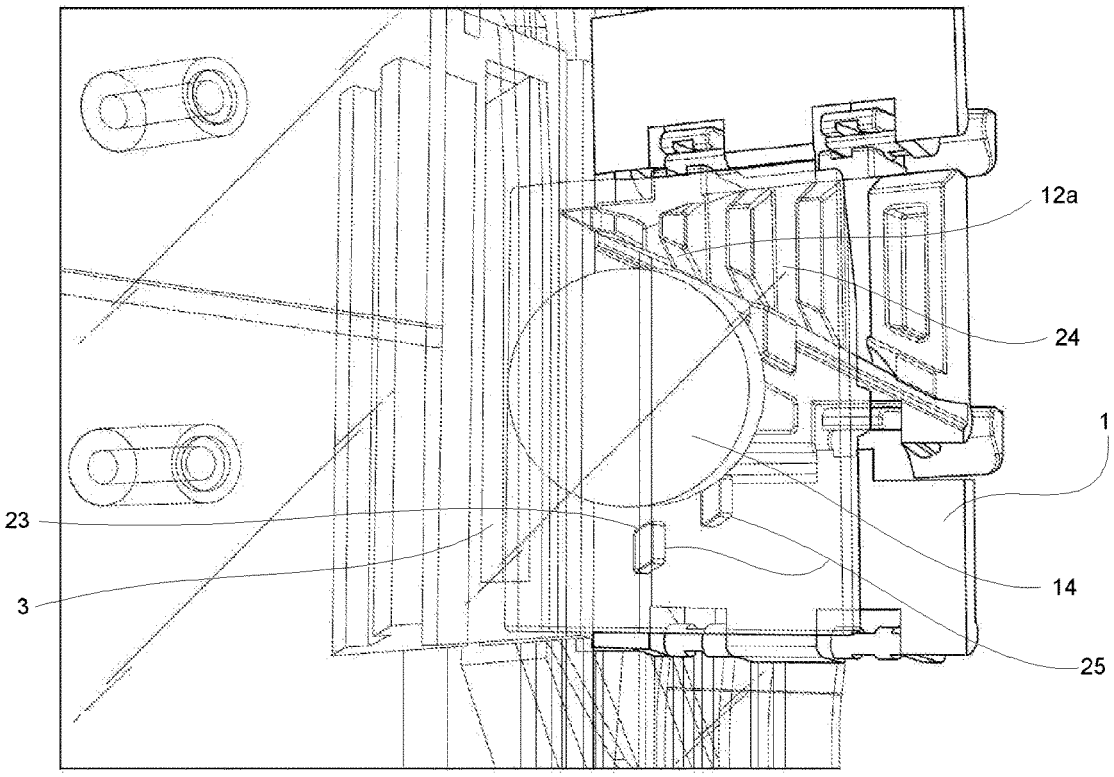
FIG. 22 is an illustration of longitudinal channels in a surface of a moving conveying member which engage with corresponding ridges in a surface of an ejecting member to eject money items off the conveying member.

In another alternative configuration, the ejecting surface 23 is not part of the moving conveyor 4 but instead interacts with money items 14 on the moving conveyor 14 to direct them into the exit 3. For example, as shown in FIGS. 21 and 22, the ejecting surface 23 may be located on a projection of the static guide 17 which extends across, and is adjacent to, the money item guide supports 12*b* of the conveying members 1 as the members 1 move past the location of the exit 3. The money items 14 on the conveying members 1 strike the surface 23 of the projection as previously described and are directed into the exit 3 by the angled nature of the ejecting surface 23. In order to ensure that a money item 14 does not slip through a gap between a conveying member 1 and the ejecting surface 23, the projection on which the ejecting surface 23 is located and the conveying members 1 may engage with one another as the members 1 pass the exit 3. For example, as illustrated in FIGS. 21 and 22, the upstanding conveying support 12*a* of each conveying member 1 may comprise one or more longitudinal channels 24 which engage with corresponding longitudinal ridges 25 on which the ejecting surface 23 is located as the members 1 pass the exit 3.

The ejecting surface 23 allows the money items 14 to be ejected over the same edge 8 of the conveyor 4 from which they were initially received. This is advantageous because it allows the money items 14 to be transported around the conveyor 4 on the money item receiving edge 8 side of the guide support 12*b*. There is no requirement for the money items 14 to be moved across the guide support 12*b* to the other edge 16 of the conveyor 4, meaning that there is space there for surplus money items 15 to be released as previously described. The ability to convey the money items 14 on the receiving edge 8 of the conveyor 4 also allows the money items 14 to be moved into the plane of the sensors 22 located adjacent the money item receiving edge 8 of the conveyor 4, meaning that the money items 14 can be validated or otherwise checked as they move along the conveyor path.

Figure 23:
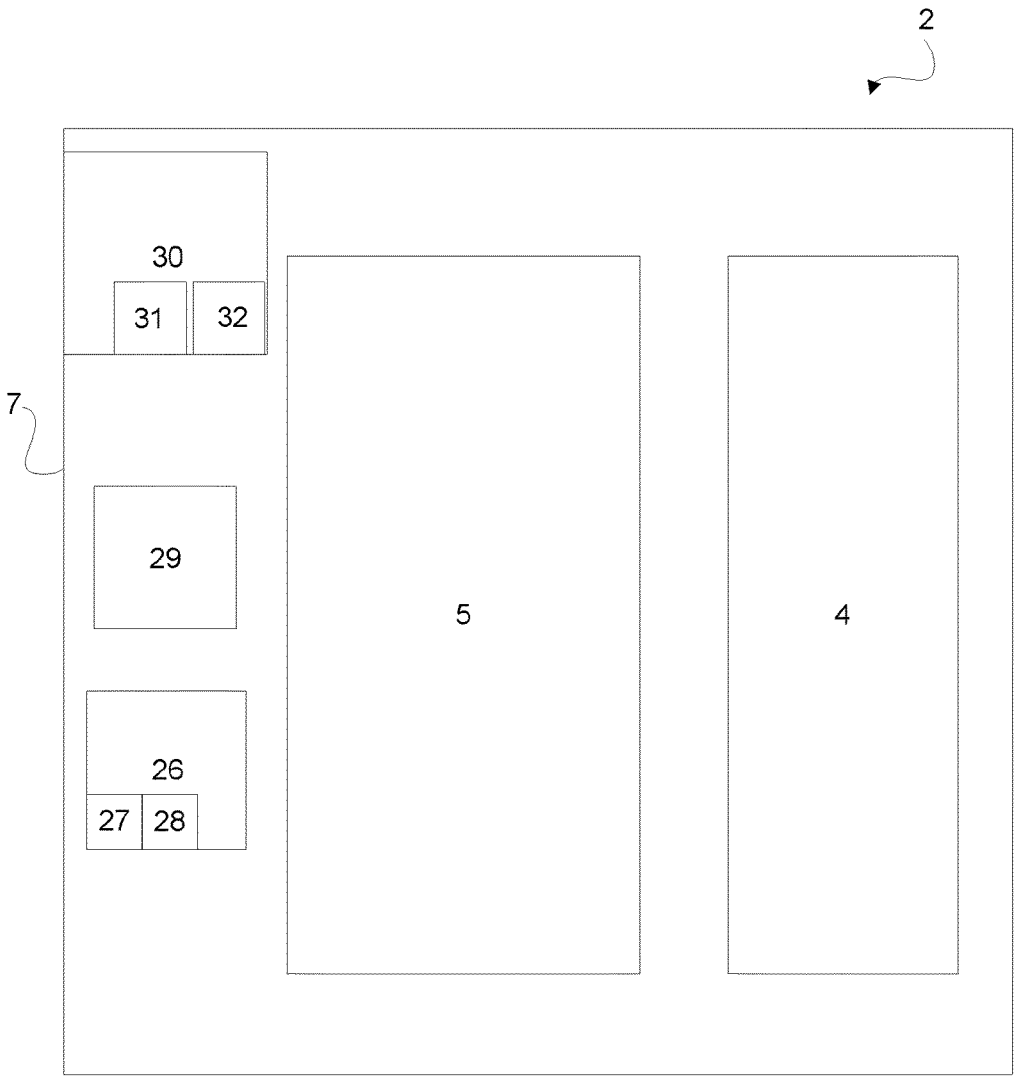
FIG. 23 is a schematic illustration of a money item conveying system.

Referring to FIG. 23, the operation of the conveying system 2, including that of the conveyors 4, may be controlled by an electronic controller 26. The controller 26 comprises an electronic processor 27, such as a microprocessor 28, and a computer readable storage medium 28 which stores computer readable instructions in a computer program. The computer readable storage medium 28 may comprise, for example, one or more read-only memories (ROMs), random access memories (RAMs), EPROMs, EEPROMs, Flash memories, magnetic or optical cards or application specific integrated circuits (ASICs). Additionally or alternatively, the computer readable storage medium 28 may comprise any type of storage disk, such as one or more floppy disks, optical disks, CD-ROMs and/or magnetic-optical disks, or any other type of media suitable for storing electronic instructions which can be executed by the processor 27. The computer readable storage medium(s) 28 is coupled to the processor 27 and other elements of the controller architecture 26 via a computer system bus. The processor 27 is configured to implement the instructions under the control of the program to operate the system 2. For example, the controller 26 may be communicatively coupled to a power supply 29 of each of the elements of the system 2 so that the controller 26 can cause movement of the conveyor(s) 4 and operation of the other elements of the system 2 as required.

For the avoidance of doubt, the controller 26 may include a single processor 27 or may comprise one or more architectures employing multiple processor designs 27 for increased computing capability. Furthermore, it will be appreciated that although the system 2 has been described as comprising two conveyors 4, the system 2 may alternatively comprise a single conveyor 4. The aspects of the conveyors 4 and the system 2 described above are equally applicable to one which comprises only a single conveyor 4. Equally, the aspects are also applicable to a conveying system 2 which comprises more than two conveyors 4.

The sensors 22 have been described as being located on the money item source 5, e.g. hopper side of the conveyors 4, rather than being located on the opposite side near the side face 7*a* of the housing 7. However, an alternative is for the sensors 22 to be located on the opposite side of the conveyors 4 to the money item sources 5, with the money items 14 being guided through a sensing region which is out of the plane of the conveyors 4 on that opposite side.

Additional elements of the system 2 which have not been described above include one or more money item acceptors 30, which receive money items from an external input 31 in the housing 7 and selectively feed the money items into the hopper(s) 5. The additional elements may also include one or more money item discriminators 32 attached to the hoppers 5, which are configured to discriminate between different money items in a hopper 5 and feed the required type of money item onto the conveyor 4. The use of a discriminator may be convenient if one or more of the hoppers 5 is to contain a plurality of different types of money item, such as different denominations of coin.

The invention claimed is:

1. A money item conveying system comprising:

a conveyor configured to convey money items along a conveyor path, the conveyor comprising a longitudinal edge and an angled conveying support against which an edge of a primary money item is located during conveyance; and a guide located adjacent to the longitudinal edge of the conveyor and configured to support the money item to remain on the conveyor while the angled conveying support urges primary money items against the guide as the primary money items are conveyed, and wherein the guide comprises an agitating region configured to agitate movement of surplus money items away from the guide and off the conveyor in order to isolate the primary money item on the conveyor.

2. The money item conveying system according claim 1, wherein movement of a money item into the agitating region of the guide causes opposing movement of a surplus money item into a money item release section of the conveyor.

3. The money item conveying system according to claim 1, wherein the conveyor is configured to direct primary money items at least partially out of a conveying plane of the conveyor in the agitating region of the conveyor path.

4. The money item conveying system according to claim 1, wherein the agitating region of the guide comprises a region that extends towards the conveyor configured to physically contact edges of surplus money items on the conveyor and direct the surplus money items into a money item release section of the conveyor.

5. The money item conveying system according to claim 4, wherein the region is configured to contact surplus money items that are resting edge to edge with another money item and that are forward of the other money item in a conveying direction of the conveyor.

6. The money item conveying system according to claim 1, wherein the agitating region of the guide is in a money item escalating region of the conveyor path.

7. The money item conveying system according to claim 1, wherein the money items are coins or substantially circular tokens.

8. The money item conveying system according to claim 1, wherein the guide comprises a groove where the edges of the primary money items are received as the money items are conveyed.

9. The money item conveying system according to claim 1, wherein the conveyor comprises:

a money item conveying surface arranged to convey a received money item forward when an edge of the money item contacts the money item conveying surface; and a money item ejecting surface arranged to direct the money item off the conveyor when an edge of the money item contacts the money item ejecting surface;

wherein the money item conveying surface and the money item ejecting surface converge towards one another.

10. The money item conveying system according to claim 9, wherein the conveyor is arranged to support the money item between the money item conveying surface and the money item ejecting surface during conveyance.

11. The money item conveying system according to claim 9, wherein the money item ejecting surface is located forward of the money item conveying surface in a conveying direction of the conveyor.

12. The money item conveying system according to claim 9, wherein the money item conveying surface and the money item ejecting surface are upstanding from a guide surface of the conveyor that is arranged to support a main face of the money item.

13. The money item conveying system according to claim 12, wherein the money item conveying surface and the money item ejecting surface are separated by the guide surface.

14. The money item conveying system according to claim 9, wherein a plane of the money item conveying surface and a plane of the money item ejecting surface are approximately perpendicular to a conveying direction of the conveyor.

15. The money item conveying system according to claim 9, wherein movement of the money item from the money item conveying surface to the money item ejecting surface causes the money item to be directed off the conveyor by its impact angle with the money item ejecting surface.

16. The money item conveying system according to claim 9, the money item conveying surface and the money item ejecting surface extend towards one another from the longitudinal edge of the conveyor.

17. The money item conveying system according to claim 16, wherein the money item conveying surface extends from said longitudinal edge of the conveyor in a direction that is partially across the conveyor and partially in a conveying direction of the conveyor.

18. The money item conveying system according to claim 16, wherein the money item ejecting surface extends from the longitudinal edge of the conveyor in a direction that is partially across the conveyor and partially in an opposite direction to a conveying direction of the conveyor.

19. The money item conveying system according to claim 9, wherein the money item conveying surface is located on a moving part of the conveyor and the money item ejecting surface is located on a static part of the conveyor so that the money item conveying surface conveys the money item towards the money item ejecting surface.

20. A method for a money item conveying system, the method comprising:

conveying, on a conveyor, money items along a conveyor path using an angled conveying support against which an edge of a primary money item is located during conveyance; and supporting, along a guide located adjacent to a longitudinal edge of the conveyor, the money item to remain on the conveyor while the angled conveying support urges primary money items against the guide as the primary money items are conveyed, and agitating, in an agitating region of the guide, movement of surplus money items away from the guide and off the conveyor in order to isolate the primary money item on the conveyor.

* * * * *